US008014703B2

(12) United States Patent
Ohmura et al.

(10) Patent No.: US 8,014,703 B2
(45) Date of Patent: Sep. 6, 2011

(54) DEVELOPMENT DEVICE AND IMAGE FORMING APPARATUS

(75) Inventors: Tomoya Ohmura, Yokohama (JP); Junichi Matsumoto, Yokohama (JP); Nobuo Iwata, Sagamihara (JP); Natsumi Katoh, Atsugi (JP)

(73) Assignee: Ricoh Company Limited, Tokyo (JP)

( * ) Notice: Subject to any disclaimer, the term of this patent is extended or adjusted under 35 U.S.C. 154(b) by 536 days.

(21) Appl. No.: 12/130,092

(22) Filed: May 30, 2008

(65) Prior Publication Data

US 2008/0298845 A1 Dec. 4, 2008

(30) Foreign Application Priority Data

May 31, 2007 (JP) ..... 2007-145444

(51) Int. Cl.
*G03G 15/08* (2006.01)

(52) U.S. Cl. ..... 399/256; 399/254

(58) Field of Classification Search ..... 399/254, 399/256, 263

See application file for complete search history.

(56) References Cited

U.S. PATENT DOCUMENTS

| | | | | |
|---|---|---|---|---|
| 5,249,019 | A * | 9/1993 | Ishida et al. | 366/318 |
| 5,561,506 | A * | 10/1996 | Kasahara | 399/256 |
| 5,657,115 | A * | 8/1997 | Sugihara | 399/263 |
| 5,734,957 | A * | 3/1998 | Ogawa et al. | 399/359 |
| 5,835,827 | A | 11/1998 | Kishimoto | |
| 6,985,685 | B2 * | 1/2006 | Shigeta et al. | 399/254 |
| 7,085,522 | B2 | 8/2006 | Muramatsu et al. | |
| 7,127,198 | B2 | 10/2006 | Muramatsu et al. | |
| 7,346,286 | B2 | 3/2008 | Matsumoto et al. | |
| 7,356,288 | B2 | 4/2008 | Iwata et al. | |
| 2002/0154914 | A1 | 10/2002 | Funayama et al. | |
| 2003/0053825 | A1 | 3/2003 | Livadas et al. | |
| 2003/0156859 | A1 | 8/2003 | Tamai | |
| 2005/0084299 | A1 * | 4/2005 | Choi et al. | 399/281 |
| 2005/0281592 | A1 | 12/2005 | Muramatsu et al. | |
| 2006/0222414 | A1 * | 10/2006 | Yamamura | 399/263 |

(Continued)

FOREIGN PATENT DOCUMENTS

DE 197 42 668 A1 4/1999

(Continued)

OTHER PUBLICATIONS

Machine translation of Furuya et al. (Jp 10-063,081), Pub date Mar. 6, 1998, Listed in IDS.*

(Continued)

*Primary Examiner* — David M Gray
*Assistant Examiner* — Rodney Bonnette
(74) *Attorney, Agent, or Firm* — Oblon, Spivak, McClelland, Maier & Neustadt, L.L.P.

(57) ABSTRACT

The development device includes a development member and a circulation member. The development member develops an electrostatic latent image formed on a latent image carrier with a developer including toner and a carrier to make the electrostatic latent image visible. The circulation member receives the developer discharged from the development member and conveys the developer back to the development member. The circulation member includes a container provided upstream from the development member in a conveyance direction of the developer to store the developer. The container includes an agitator provided inside the container and agitates and mixes the developer and fresh toner supplied to the container. The agitator includes a rotatable agitation member in which one or more holes are formed through which the developer passes to mix the fresh toner and the developer to be agitated in the container.

16 Claims, 8 Drawing Sheets

U.S. PATENT DOCUMENTS

| | | | | |
|---|---|---|---|---|
| 2007/0009289 | A1 | 1/2007 | Muramatsu et al. | |
| 2007/0053721 | A1 | 3/2007 | Matsumoto et al. | |
| 2007/0053723 | A1 | 3/2007 | Iwata et al. | |
| 2007/0154242 | A1 | 7/2007 | Matsumoto et al. | |
| 2007/0166079 | A1* | 7/2007 | Ichikawa et al. | 399/254 |
| 2007/0264053 | A1 | 11/2007 | Iwata et al. | |
| 2007/0274740 | A1 | 11/2007 | Katoh et al. | |

FOREIGN PATENT DOCUMENTS

| | | |
|---|---|---|
| JP | 4-344668 | 12/1992 |
| JP | 6-35314 | 2/1994 |
| JP | 7-219347 | 8/1995 |
| JP | 10-63081 | 3/1998 |
| JP | 11-202708 | 7/1999 |
| JP | 2001-188408 | 7/2001 |
| JP | 3349286 | 9/2002 |
| JP | 2005-70385 | 3/2005 |
| JP | 3995867 | 8/2007 |

OTHER PUBLICATIONS

Office Action issued Mar. 10, 2011, in European Patent Application No. 08 157 292.7-2209.

* cited by examiner

DEVELOPMENT DEVICE AND IMAGE FORMING APPARATUS

CROSS-REFERENCE TO RELATED APPLICATION

The present application is based on and claims priority from Japanese Patent Application No. 2007-145444, filed on May 31, 2007 in the Japan Patent Office, the entire contents of which are hereby incorporated herein by reference.

BACKGROUND OF THE INVENTION

1. Field of the Invention

Exemplary aspects of the present invention relate to a development device and an image forming apparatus, and more particularly, to a development device and an image forming apparatus for efficiently agitating a two-component developer.

2. Description of the Related Art

A related-art image forming apparatus, such as a copier, a facsimile machine, a printer, or a multifunction printer having at least one of copying, printing, scanning, and facsimile functions, typically forms a toner image on a recording medium (e.g., a transfer sheet) according to image data using electrophotography. Thus, for example, in a typical electrophotographic image forming process, a charging device charges a surface of a latent image carrier; an optical writer emits a light beam onto the charged surface of the latent image carrier to form an electrostatic latent image on the latent image carrier according to the image data; a development device develops the electrostatic latent image with a developer to form a toner image on the latent image carrier; the toner image is transferred from the latent image carrier onto a transfer sheet; and a fixing device applies heat and pressure to the transfer sheet bearing the toner image to fix the toner image on the transfer sheet, thus transferring the toner image onto the transfer sheet.

One common type of developer is a two-component developer, which includes toner and a carrier for carrying the toner. When the developer is agitated and mixed inside the development device, the toner is charged by friction generated between the toner and the carrier and electrostatically attracted to the electrostatic latent image formed on the latent image carrier, thereby forming a toner image.

One known configuration for a development device includes a development member and an agitation member. The agitation member agitates and mixes developer to generate frictional charge between toner and a carrier, and supplies the development member with the developer. The development member supplies the developer to a surface of a latent image carrier carrying an electrostatic latent image to develop the electrostatic latent image into a toner image with the developer.

One known related-art image forming apparatus includes a development device including a paddle for agitating the developer. The paddle includes a rotary shaft and a blade radially extending from the rotary shaft, enabling the paddle to rotate to agitate and mix the developer so as to charge the toner by friction. However, when the paddle has a small surface area, the paddle may not contact all of the developer, thereby causing insufficient dispersion and charging of the toner.

Another known related-art image forming apparatus includes a development device including a screw auger as an agitator. When the amounts involved are not large, such rotating screw auger arrangement can efficiently agitate and mix the components of the developer. However, when a large amount of toner is consumed and supplied, the screw auger may not sufficiently agitate the developer. Consequently, the toner may not be sufficiently dispersed and charged by friction. Insufficiently charged toner may be adhered to a non-image area in which an electrostatic latent image is not formed on a surface of a latent image carrier, or scatter to other peripheral devices, resulting in degradation of image quality.

Toner agitation may be improved by increasing a rotation speed of the paddle or the screw auger. However, doing so may increase a load on a drive system for driving the paddle or the screw auger of the development device, or may cause degradation of toner due to heat of friction generated by agitation.

Obviously, such insufficient charging of toner is undesirable, and accordingly, there is a need for a technology to efficiently agitate developer to supply toner to achieve proper electrical charging without degradation of the developer.

BRIEF SUMMARY OF THE INVENTION

This specification describes a development device according to exemplary embodiments of the present invention. In one exemplary embodiment of the present invention, the development device includes a development member and a circulation member. The development member is configured to develop an electrostatic latent image formed on a latent image carrier with a developer including toner and a carrier to make the electrostatic latent image visible. The circulation member is configured to receive the developer discharged from the development member and convey the developer back to the development member. The circulation member includes a container. The container is provided upstream from the development member in a conveyance direction of the developer to store the developer. The container includes an agitator. The agitator is provided inside the container and configured to agitate and mix the developer and fresh toner supplied to the container. The agitator includes a rotatable agitation member in which one or more holes are formed through which the developer passes to mix the fresh toner and the developer to be agitated in the container.

This specification further describes an image forming apparatus according to exemplary embodiments of the present invention. In one exemplary embodiment of the present invention, the image forming apparatus includes a latent image carrier and a development device. The latent image carrier is configured to carry an electrostatic latent image. The development device is configured to develop the electrostatic latent image carried by the latent image carrier. The development device includes a development member and a circulation member as described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
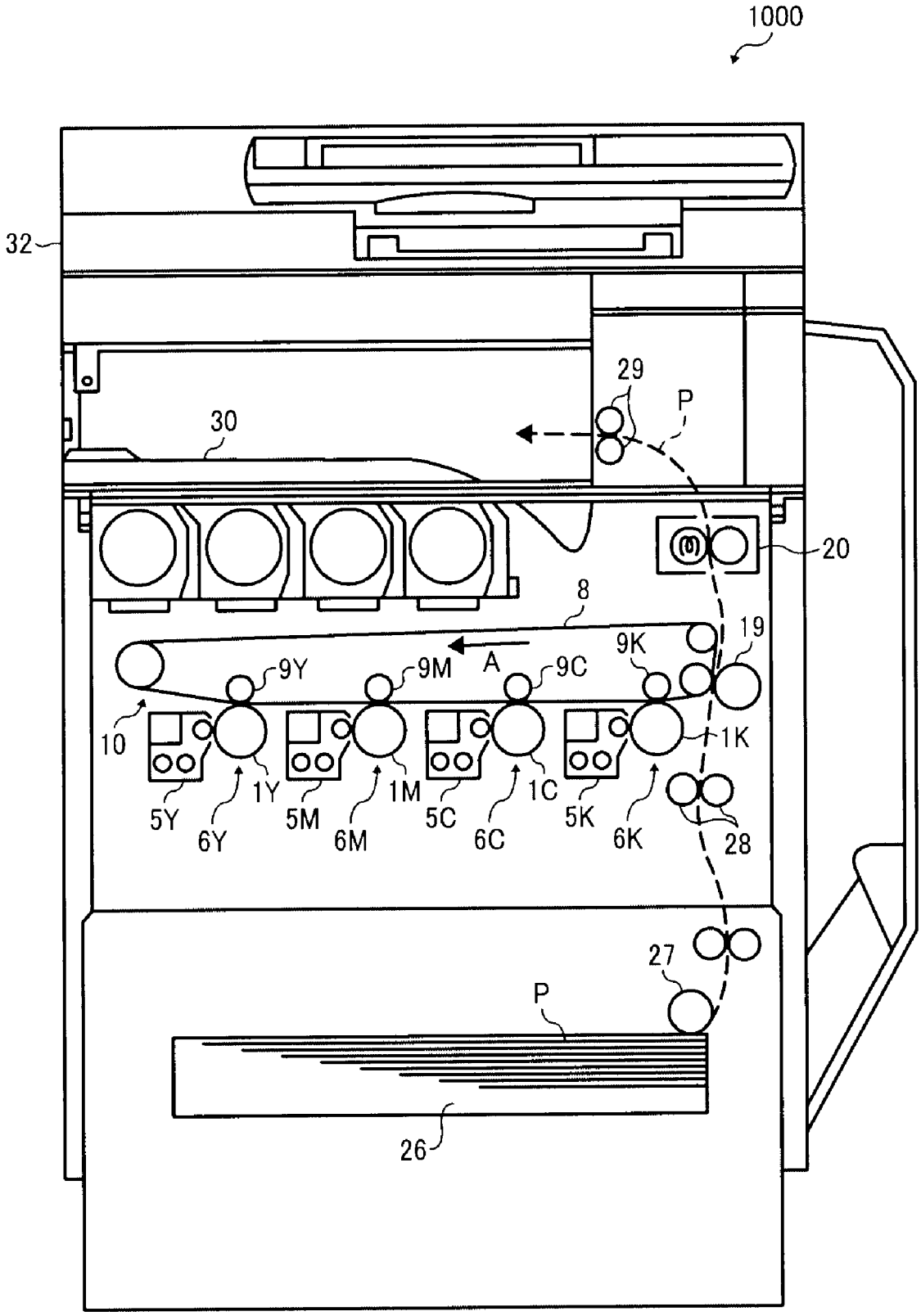
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1000 according to an exemplary embodiment of the present invention is described.

FIG. 1 illustrates one example of the image forming apparatus 1000. The image forming apparatus 1000 includes imaging devices 6Y, 6M, 6C, and 6K, primary transfer bias rollers 9Y, 9M, 9C, and 9K, an intermediate transfer unit 10, a secondary transfer roller 19, a fixing device 20, a feeding device 26, a feeding roller 27, a registration roller pair 28, a discharge roller pair 29, a discharge device 30, and a reading device 32. The imaging devices 6Y, 6M, 6C, and 6K include photoconductor drums 1Y, 1M, 1C, and 1K, and development devices 5Y, 5M, 5C, and 5K. The intermediate transfer unit 10 includes an intermediate transfer belt 8.

The image forming apparatus 1000 may be a copier, a facsimile machine, a printer, a multifunction printer having at least one of copying, printing, scanning, and facsimile functions, or the like. According to this non-limiting example embodiment, the image forming apparatus 1000 functions as a tandem type color copier for forming a color image on a recording medium (e.g., a transfer sheet) by electrophotography. However, the image forming apparatus 1000 is not limited to the color copier and may form a color and/or monochrome image in other configurations.

The imaging devices 6Y, 6M, 6C, and 6K are provided side by side to oppose an outer circumferential surface of the intermediate transfer belt 8, serving as an unfixed image carrier, and form yellow, magenta, cyan, and black toner images, respectively.

The imaging devices 6Y, 6M, 6C, and 6K perform imaging processes for forming a desired toner image on the photoconductor drums 1Y, 1M, 1C, and 1K, respectively. The imaging processes include a charging process, an exposure process, a development process, a transfer process, and a cleaning process.

The imaging processes performed by the imaging device 6Y is described. The imaging devices 6M, 6C, and 6K have a structure equivalent to that of the imaging device 6Y.

A charging device (not shown) is provided around the photoconductor drum 1Y serving as a latent image carrier. When the photoconductor drum 1Y is driven to rotate clockwise by a driver (not shown), the charging device uniformly charges a surface of the photoconductor drum 1Y in the charging process.

An exposure device (not shown, e.g., an optical writer) is provided under the imaging device 6Y and emits a laser beam to the charged surface of the photoconductor drum 1Y based on image information sent from the reading device 32 to form an electrostatic latent image on the photoconductor drum 1Y in the exposure process. In the development process, the development device 5Y supplies a developer to the photoconductor drum 1Y to develop the electrostatic latent image formed on the surface of the photoconductor drum 1Y with toner included in the developer, so that the electrostatic latent image is made visible as a toner image.

In the primary transfer process, when the surface of the photoconductor drum 1Y carrying the toner image reaches a position at which the intermediate transfer belt 8 opposes the primary transfer bias roller 9Y, the toner image is transferred onto the intermediate transfer belt 8.

In the cleaning process, a cleaning device (not shown) collects residual toner remaining on the photoconductor drum 1Y when the surface of the photoconductor drum 1Y, from which the toner image has been transferred to the intermediate transfer belt 8, opposes the cleaning device. Thereafter, a discharge roller (not shown) resets electrical potentials of the surface of the photoconductor drum 1Y.

After the imaging devices 6Y, 6M, 6C, and 6K perform the development process, respectively, the yellow, magenta, cyan, and black toner images formed on the photoconductors 1Y, 1M, 1C, and 1K, respectively, are transferred and superimposed onto the intermediate transfer belt 8, thereby forming a full color toner image on the intermediate transfer belt 8.

The intermediate transfer roller 8 is sandwiched between the primary transfer bias rollers 9Y, 9M, 9C, and 9K, and the photoconductors 1Y, 1M, 1C, and 1K to form primary transfer nips. The primary transfer bias rollers 9Y, 9M, 9C, and 9K are supplied with a transfer bias having a polarity opposite to a polarity of the toner.

The intermediate transfer belt 8 moves in a direction A and passes the primary transfer nips formed between the primary transfer bias rollers 9Y, 9M, 9C, and 9K and the photoconductors 1Y, 1M, 1C, and 1K, respectively. Accordingly, the yellow, magenta, cyan, and black toner images formed on the photoconductors 1Y, 1M, 1C, and 1K, respectively, are transferred and superimposed onto the intermediate transfer belt 8.

After this primary transfer of the toner images, the intermediate transfer belt 8 opposes the secondary transfer roller 19. When a recording medium (e.g., a transfer sheet P) is conveyed to a secondary transfer nip formed between the intermediate transfer belt 8 and the secondary transfer roller 19, the full color toner image formed on the intermediate transfer belt 8 is transferred onto the transfer sheet P.

The feeding device 26 is provided in a lower portion of the image forming apparatus 1000 and stores a plurality of transfer sheets P. The feeding roller 27 separates one transfer sheet P from other transfer sheets P and feeds the transfer sheet P toward the registration roller pair 28. The registration roller pair 28 temporarily stops the transfer sheet P, corrects a conveyance direction of the transfer sheet P (e.g., an oblique misalignment), and sends the transfer sheet P toward the secondary transfer nip at a proper time, so that a desired color toner image is transferred onto the transfer sheet P.

When the transfer sheet P bearing the color toner image is conveyed to the fixing device 20, a fixing roller (not shown) and a pressure roller (not shown) of the fixing device 20 fix the color toner image on the transfer sheet P by heat and pressure.

After the fixation, the transfer sheet P is sent toward the discharge roller pair 29. The discharge roller pair 29 discharges the transfer sheet P as an output image to the discharge device 30 provided in an upper portion of the image forming apparatus 1000. Accordingly, the image forming apparatus 1000 finishes a series of image forming processes.

Figure 2:
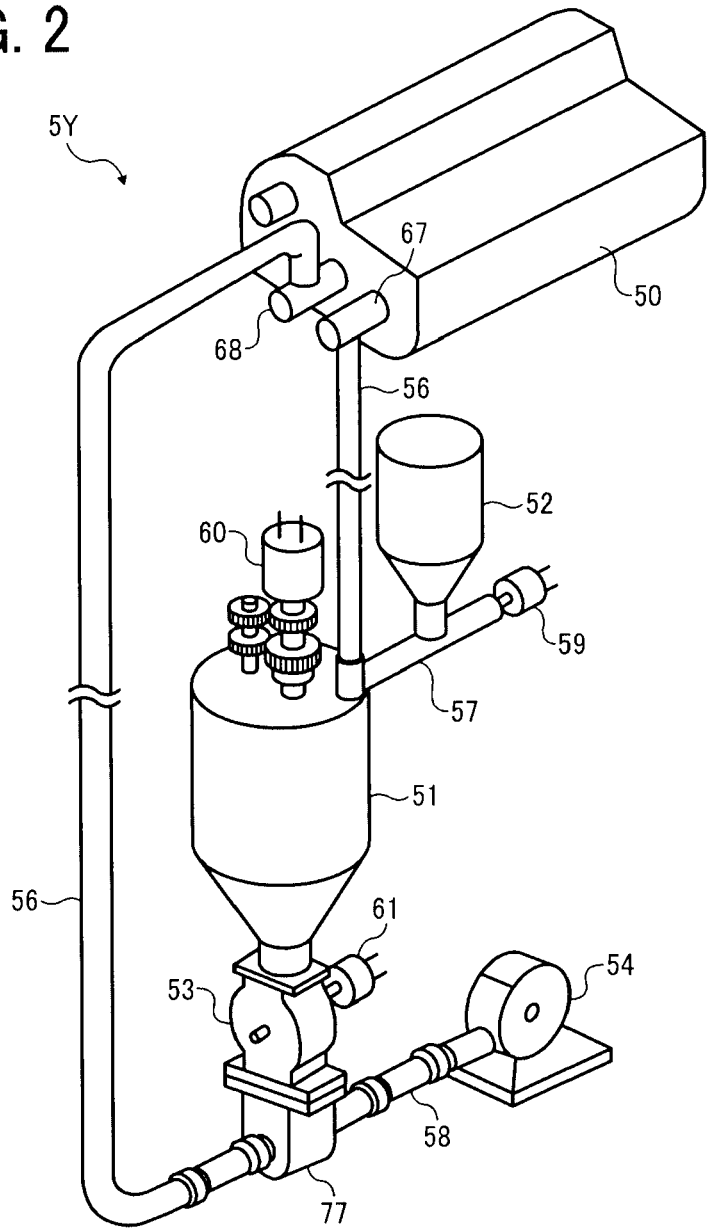
FIG. 2 is a perspective view of a development device included in the image forming apparatus shown in FIG. 1.
Figure 3:
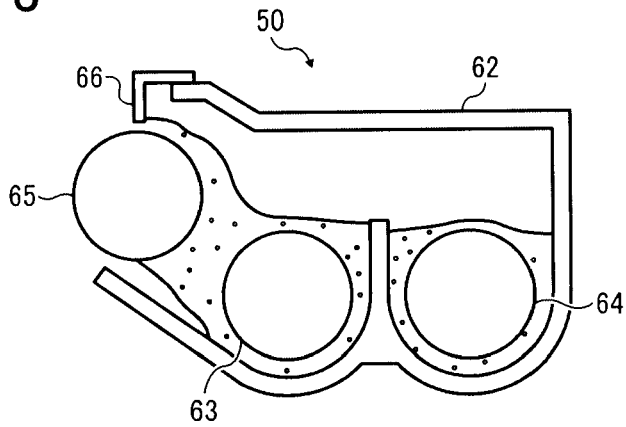
FIG. 3 is a sectional view of a development member included in the development device shown in FIG. 2.

Referring to FIGS. 2 and 3, a description is now given of a structure of the development device 5Y. FIG. 2 is a perspective view of the development device 5Y according to this exemplary embodiment. As illustrated in FIG. 2, the development device 5Y includes a development member 50, a developer container 51, a toner cartridge 52, a rotary feeder 53, an air pump 54, a circulation path 56, a toner supply path 57, a duct 58, motors 59, 60, and 61, an outlet 67, an inlet 68, and a pipe fittings 77. The development devices 5M, 5C, and 5K have a structure equivalent to that of the development device 5Y. FIG. 3 is a sectional view of the development member 50. As illustrated in FIG. 3, the development member 50 includes a casing 62, screws 63 and 64, a development roller 65, and a doctor blade 66.

As illustrated in FIG. 2, the development device 5Y includes a development member (e.g., the development member 50) and a circulation member (e.g., the circulation path 56). The development member 50 develops an electrostatic latent image formed on the photoconductor drum 1Y (depicted in FIG. 1) with a two-component developer in which a carrier and toner are mixed. The circulation path 56 continuously sends the developer discharged from the development member 50 to a developer supplier (e.g., the screws 63 and 64 depicted in FIG. 3) of the development member 50.

According to this exemplary embodiment, the development member 50 is formed into a cartridge. The toner cartridge 52 supplies fresh toner to the developer container 51. The developer container 51 is separated from the development member 50, and agitates and mixes the developer discharged from the development member 50 and the fresh toner supplied from the toner cartridge 52. After being agitated and mixed, the developer is discharged from the developer container 51 and sent by the rotary feeder 53 toward the development member 50. The air pump 54 functions as a driver for generating a driving force for sending the developer to the development member 50Y by air pressure.

The development member 50 is connected to the developer container 51 via the circulation path 56, serving as a circulation member. The circulation path 56 includes an outward path connected to the developer container 51 and a return path connected to one of the screws 63 and 64 (depicted in FIG. 3), serving as a developer supplier, of the development member 50. For example, when the developer is discharged from the development member 50, the developer moves to the developer container 51 via the outward path of the circulation path 56. When the developer is discharged from the developer container 51, the developer returns to the development member 50 via the return path of the circulation path 56.

The motor 59 serves as a driver for supplying toner to the developer container 51. The motor 60 functions as a driver for generating a driving force for agitating the developer. The motor 61 functions as a driver for generating a driving force for driving the rotary feeder 53. As described later, the rotary feeder 53 is connected to the circulation path 56 and the duct 58 by the pipe fitting 77.

As illustrated in FIG. 3, the screws 63 and 64, and the development roller 65 include a spiral fin and are rotatably supported in the casing 62.

The casing 62 stores a two-component developer in which toner and a carrier are mixed. The rotating screws 63 and 64 may circulate the developer inside the casing 62.

After the screw 63 moves the developer from one end to another end of the screw 63 in an axial direction of the screw 63, a part of the developer is attracted by the development roller 65 due to magnetic force and smoothed by the doctor blade 66, so as to have uniform thickness. When the surface of the photoconductor drum 1Y (depicted in FIG. 1) contacts the developer, an electrostatic latent image formed on the photoconductor drum 1Y may be developed with the toner to form a toner image thereon.

As illustrated in FIG. 2, after the development, the developer is discharged from the outlet 67 provided in the development member 50 at an end of the screw 64 (depicted in FIG. 3) in an axial direction of the screw 64 to the developer container 51 via the outward path of the circulation path 56.

A toner density detector (not shown) is provided in a most downstream portion of the screw 64 in a conveyance direction of the developer. Based on a signal transmitted from the toner density detector, the toner cartridge 52 supplies fresh toner to the developer container 51.

The motor 59 rotates a screw (not shown) of the toner supply path 57 to send the toner discharged from the toner cartridge 52 to the developer container 51. The toner is supplied to a portion in front of an entrance of the developer container 51.

The developer container 51 agitates and mixes the developer after development and the fresh toner, such that the developer may keep a proper toner density and a proper charged amount. After being discharged from the developer container 51, the developer passes through an outlet (not shown) provided in a lower part of the developer container 51 and enters the rotary feeder 53.

Due to rotation of a rotor, described later, of the rotary feeder 53, a predetermined amount of the developer is downwardly discharged to the circulation path 56 and again supplied to the development member 50 via the inlet 68.

Figure 4:
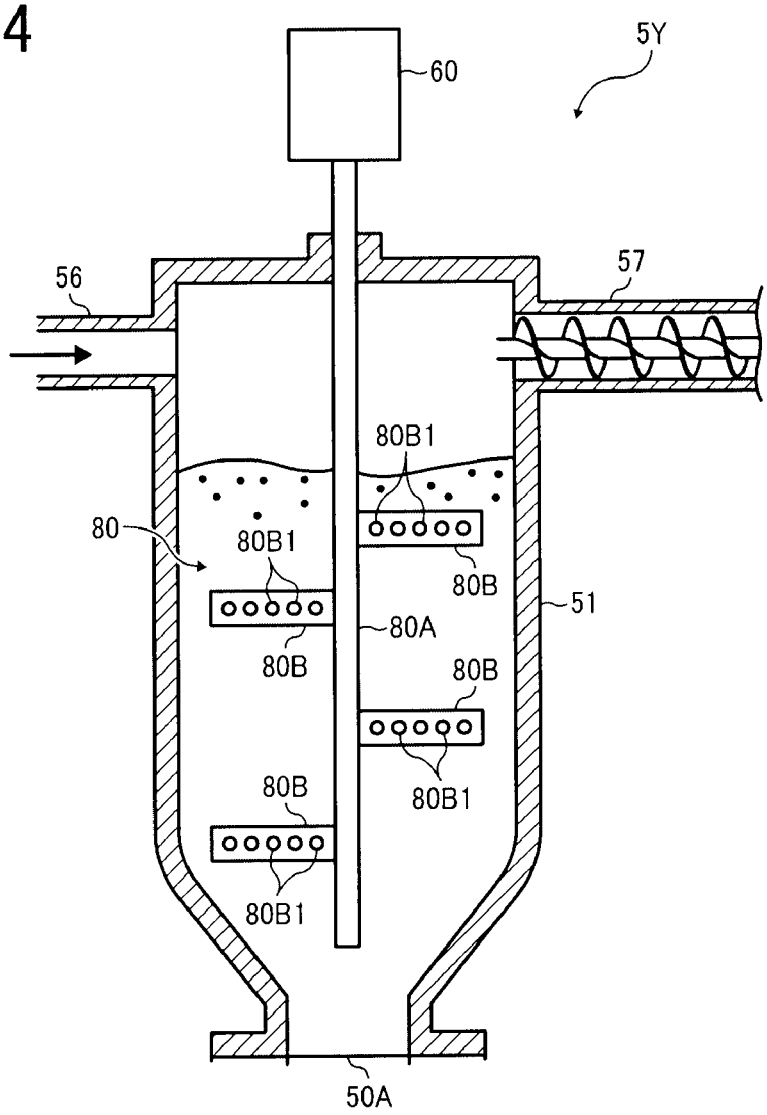
FIG. 4 is a sectional view of a developer container included in the development device shown in FIG. 2.

Referring to FIG. 4, a description is now given of a structure of the developer container 51.

FIG. 4 is a sectional view of the developer container 51 according to the exemplary embodiment. The developer container 51 includes an agitator 80 and an outlet 50A. The agitator 80 includes a rotary shaft 80A and a plurality of paddles 80B. The paddles 80B are perforated with holes 80B1.

The developer container 51 has a funnel- or cone-like shape, with a portion of decreasing diameter extending toward the outlet 50A. The return path of the developer circulation path 56 and the toner supply path 57 is connected to the developer container 51 near an upper surface of the developer container 51, with the outlet 50A of the developer provided in a lower part thereof.

The rotary shaft 80A is inserted vertically into the developer container 51 from a horizontal center position of the upper surface of the developer container 51. The paddles 80B, serving as agitation members, are provided circumferentially about the rotary shaft 80A in an axial direction of the rotary shaft 80A.

The rotary shaft 80A and the paddles BOB together form an agitator for agitating and mixing developer stored in the developer container 51, developer sent from the outward path of the circulation path 56, and fresh toner particles supplied from the toner cartridge 52 (depicted in FIG. 2) via the toner supply path 57.

The paddles 80B rotate in a direction perpendicular to a direction of developer flow from an upper part of the developer container 51 (e.g., the vicinity of the circulation path 56 and the toner supply path 57) toward the outlet 50A, so as to impede such flow without stopping it. Specifically, the developer passes through the holes 80B1 provided in a surface of the paddles 80B, which push and move the flowing developer as they rotate.

According to this exemplary embodiment, each hole 80B1 is large enough for at least a carrier included in the developer to pass through. Since a toner particle is smaller than the carrier, it also may pass through the hole 80B1.

Therefore, when the agitator 80 is activated, the plurality of paddles 80B, serving collectively as an agitation member, rotates to impede the downward flow of the developer in the developer container 51. That is, the developer receives a force applied in the direction perpendicular to the downward flow as well as a force of gravity, so that the developer may be efficiently agitated and mixed in the developer container 51.

When the paddle 80B rotates to move the developer in the developer container 51, some of the developer may pass through the hole 80B1 in the paddle 80B, thereby impeding adhesion of the developer to the paddle surface, which may be easily caused by a paddle without holes. Therefore, a load on the agitator 80 may be reduced, resulting in a load reduction of a drive system for driving the agitator 80.

Moreover, after passing through the hole 80B1, the developer may be mixed with each other, thereby achieving proper dispersion and frictional charging of the developer. In addition, the developer may be prevented from scattering outside the development device 5Y and adhering to a periphery of the development device 5Y, thereby preventing generation of an abnormal image.

Figure 5:
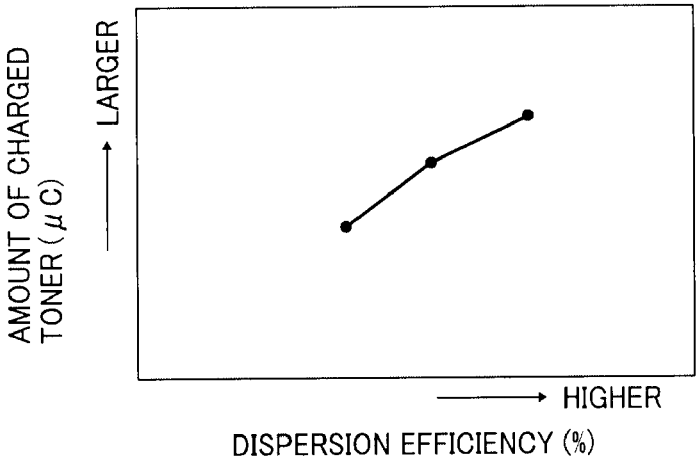
FIG. 5 is a graph illustrating a relation between dispersion efficiency and charging efficiency of a developer.

An experiment examining dispersion efficiency and charging efficiency of the developer was performed using the plurality of paddles 80B, results of which are shown in FIG. 5. When the developer is agitated by the plurality of paddles 80B (depicted in FIG. 4), compared to a case in which the developer merely flows downward without being agitated by the plurality of paddles 80B, the developer may be more efficiently agitated and a larger amount of toner may be charged.

A number of the paddles 80B provided in a circumferential direction and in an axial direction of the rotary shaft 80A depends on the rotation speed of the rotary shaft 80A (depicted in FIG. 4) so as to adjust an amount of the developer passing through the hole 80B1 in the paddle surface of the paddle 80B, thereby appropriately setting a dispersion efficiency. Dispersion efficiency corresponds to a degree of mixing of the developer according to a difference of a movement direction of the agitated developer. Therefore, provision of the plurality of holes 80B1 in the paddle 80B may increase a variety of movement directions of the developer, thereby increasing the degree of mixing of the developer, that is, dispersion efficiency of the developer.

Figure 6:
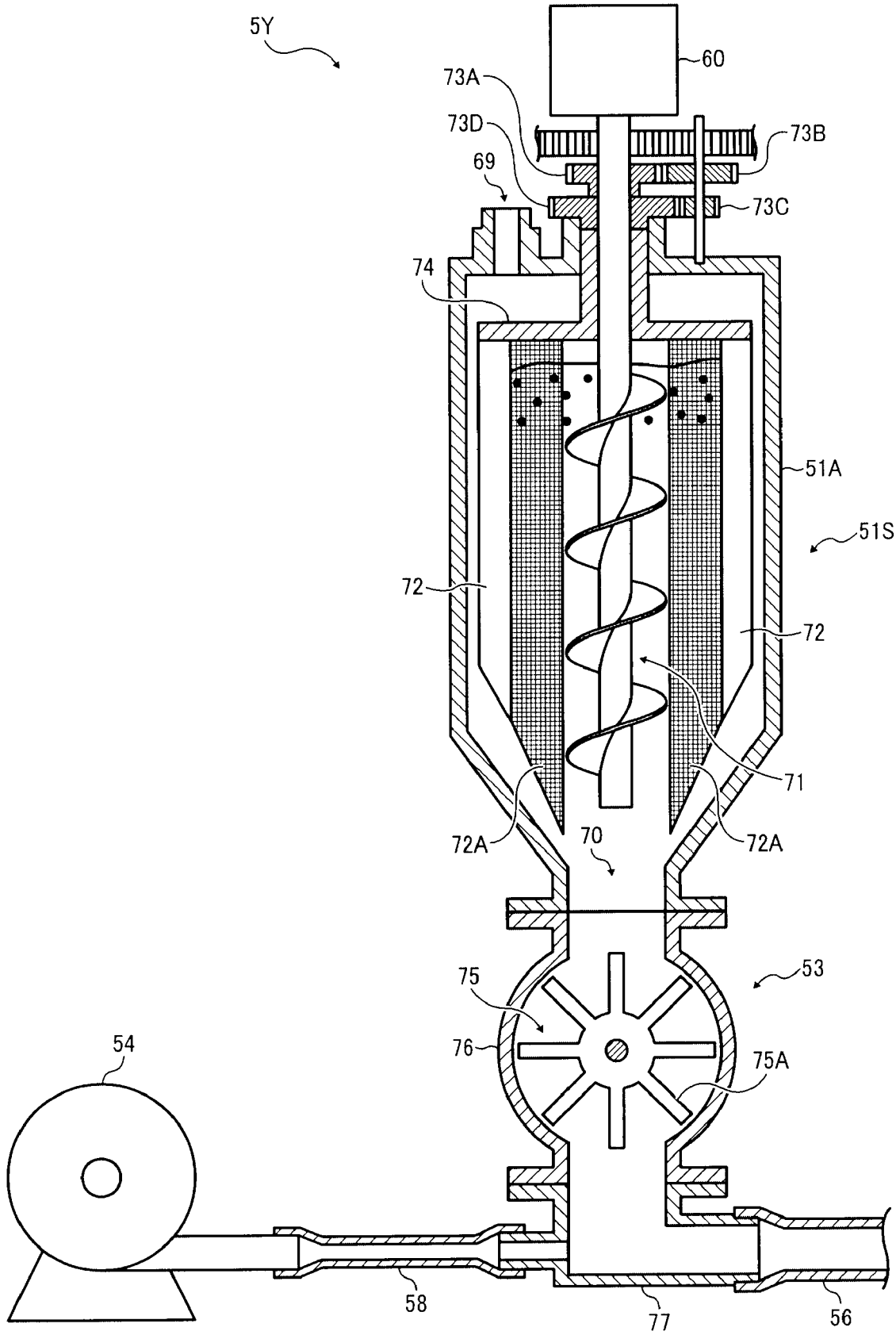
FIG. 6 is a sectional view of a developer container according to another exemplary embodiment.

Referring to FIG. 6, a description is now given of a developer container 51S of the development device 5Y according to another exemplary embodiment. FIG. 6 is a sectional view of the developer container 51S of the development device 5Y.

The development device 5Y further includes deceleration gears 73A to 73D. The rotary feeder 53 includes a rotor 75 and a stator 76. The rotor 75 includes blades 75A. The developer container 51S includes a body 51A, a developer inlet 69, an outlet 70, an inner agitator 71, outer agitators 72, and a flange 74. The outer agitator 72 includes a mesh 72A.

The developer inlet 69 is provided in an upper surface of the developer container 51S, and the outlet 70 is provided in a lower surface thereof. The body 51A of the developer container 51S has a funnel or cone-like shape, with a portion of decreasing diameter extending toward the outlet 70.

The inner agitator 71, serving as a second agitator, and the outer agitator 72, serving as a first agitator, are provided inside the body 51A of the developer container 51S, such that the inner agitator 71 is disposed on an inner side of the outer agitator 72 around a central part of the developer container 51S in a horizontal direction of the developer container 51 as a center of an axis of rotation of the inner agitator 71 and the outer agitator 72.

The inner agitator 71 is shaped like a screw auger and may rotate to move the developer upward in a predetermined direction. The outer agitator 72, provided outside the inner agitator 71, is shaped like a paddle and may rotate around the rotary shaft of the screw auger of the inner agitator 71.

One outer agitator 72 is provided at a position opposite to another outer agitator 72 across the center of the rotary shaft of the inner agitator 71 and has a longitudinal direction in a vertical direction. The flange 74 is combined with the rotary shaft of the inner agitator 71. A base of the outer agitator 72 is fixed to the flange 74. Therefore, the inner agitator 71 may move the developer in a direction opposite to the flow-down direction of the developer in the developer container 51S, and the outer agitator 72 may rotate in a direction perpendicular to the flow-down direction of the developer, thereby impeding without stopping the downward flow of the developer in the developer container 51S.

In addition, a gap between an inner end of the outer agitator 72 and an outer circumferential surface of the screw auger of the first agitator 72 is significantly small, and the mesh 72A is provided in a part of the outer agitator 72 in the inner end of the outer agitator 72 in a radial direction thereof, reducing a space in which the developer may not be caught by the inner agitator 71 and the outer agitator 72 and thereby may flow down. Moreover, an outer circumferential surface of the outer agitator 72 is substantially close to an inner surface of the developer container 51S, thereby preventing a reduction of an area of developer agitation by the outer agitator 72, even when the developer moved upward by the inner agitator 71 deviates from an area of rotation of the screw auger of the inner agitator 71.

The outer agitator 72 and the inner agitator 71 are rotated by the motor 60. The inner agitator 71 is directly connected to the motor 60, while the outer agitator 72 is indirectly connected to the motor 60 via the deceleration gears 73A to 73D.

Gravity moves the developer from the inlet 69 to the outlet 70 in the developer container 51S, and since the developer as a buffer is constantly supplied to the developer container 51S, the developer entering the developer container 51S via the inlet 69 is not discharged from the outlet 70 without being mixed in the developer container 51S.

The rotary feeder 53 is rotated with the motor 61 (depicted in FIG. 2) and provided with the rotor 75 including the plurality of blades 75A extending in a radial direction and the stator 76 covering the rotor 75. The rotary feeder 53 is connected to the circulation path 56 and the duct 58 via the pipe fittings 77.

According to the above-described exemplary embodiment, when the developer is supplied to the developer container 51S, the inner agitator 71 agitates the developer to move upward in a direction opposite to the flow-down direction of the developer so as to impede the downward flow of the developer. In addition, once the developer moves upward and again starts to flow down, the developer may be circulated in the developer container 51S by the outer agitator 72 while turning and moving in a direction perpendicular to the downward direction of flow. As a result, such movement of the developer in different directions may increase agitation efficiency of the developer.

Since the developer may pass through the mesh 72A, serving as a gap, provided in the outer agitator 72 when the developer is circulated by the inner agitator 71, serving as a second agitator, and the outer agitator 72, serving as a first agitator, the developer is not pressed against the outer agitator 72 and fixed thereto, thereby reducing stress on the developer. Moreover, since some of the developer passes through the mesh 72A of the outer agitator 72, the developer is properly dispersed. As a result, toner particles contact carrier with increased frequency, and slide on or scrape against the carrier when passing through the mesh 72A. Thus, the toner particles are properly charged by friction.

According to this exemplary embodiment, since the development device 5Y agitates the developer to impede the downward flow of the developer, an amount of the developer supplied to the developer container 51S may not be balanced with an amount of the developer discharged from the developer container 51. Therefore, according to this exemplary embodiment, in order to satisfy a relation between the amount of the supplied developer and the amount of the discharged developer, adjustment of an area of the outlet 70 and an efficiency of impeding downward flow of the developer by the outer agitator 72 may reduce such imbalance.

Figure 7A:
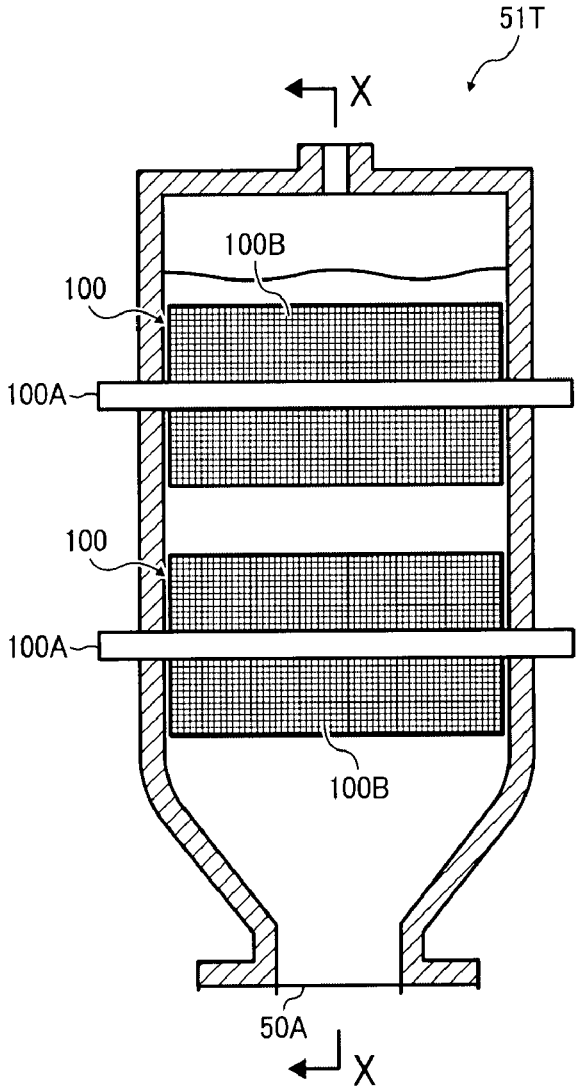
FIG. 7A is a sectional side view of a developer container according to yet another exemplary embodiment.
Figure 7B:
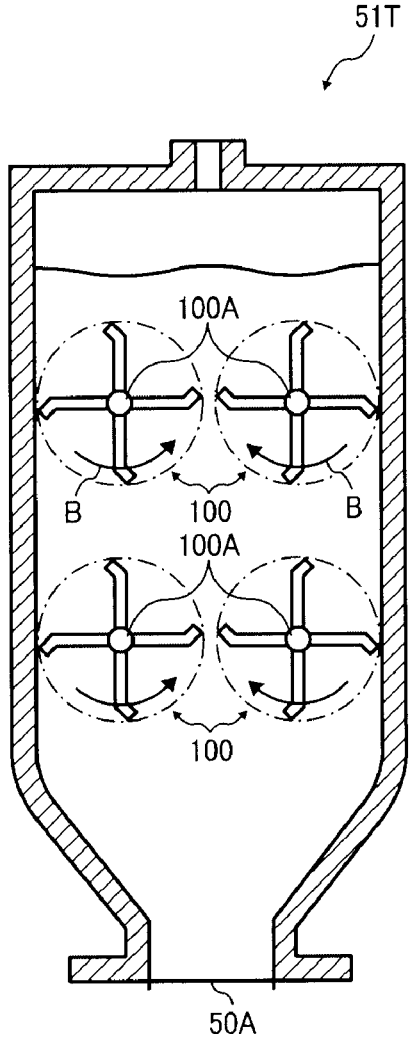
FIG. 7B is a sectional side view of the developer container shown in FIG. 7A seen in a direction X.
Figure 8:
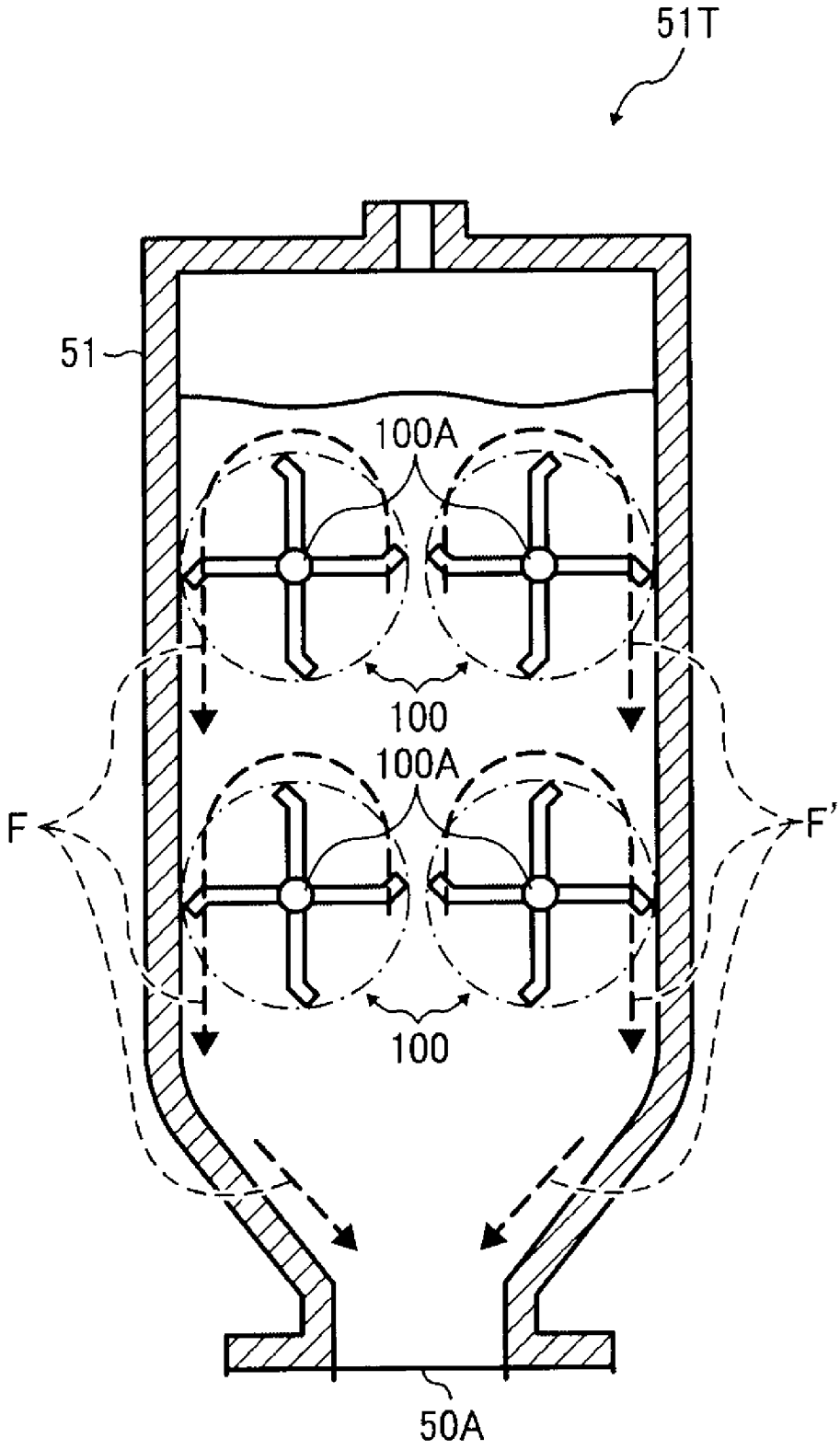
FIG. 8 is a sectional view of the developer container shown in FIG. 7B illustrating a direction of movement of a developer.

Referring to FIGS. 7A, 7B, and 8, a description is now given of a developer container 51T as a modification of the developer container 51 depicted in FIG. 4. FIG. 7A is a sectional side view of the developer container 51T. FIG. 7B is a sectional side view of the developer container 51T seen in a direction X in FIG. 7A. FIG. 8 is a sectional side view of the developer container 51T illustrating a movement direction of the developer.

As illustrated in FIGS. 7A and 7B, the developer container 51T includes paddles 100. The paddle 100 includes a rotary shaft 100A and a paddle surface 100B.

As illustrated in FIG. 7A, the paddle 100 serves as an agitator and the rotary shaft 100A of the paddle 100 extends in a horizontal direction perpendicular to a flow-down direction of the developer. A plurality of rows of rotary shafts 100A is provided in the developer container 51T along the flow-down direction of the developer.

Since the rotary shaft 100A extends in the horizontal direction, when the developer container 51T has a rectangular shape in a horizontal section, the paddle 100 fits in the developer container 51T, as illustrated in FIG. 7A.

Since the paddle surface 100B of the paddle 100 includes a mesh, serving as a gap, when the paddle 100 moves to push the developer, the developer passes through the mesh.

As illustrated in FIG. 7B, a plurality of columns of paddles 100 is provided in the developer container 51T along a horizontal direction while a plurality of rows of paddles 100 is provided in the developer container 51T along the flow-down direction of the developer. In any one row of paddles 100, one paddle 100 rotates in a direction different from a direction in which another paddle 100 rotates, as indicated by arrows B in FIG. 7B. Like the above-described exemplary embodiments, the paddle 100 rotates in a direction impeding downward flow of the developer. Namely, the paddle 100 agitates the developer in a direction different from the flow-down direction of the developer to circulate the developer in the developer container 51T. That is, as indicated by arrows F and F' in FIG. 8 illustrating circulation of the developer, as the paddle 100 rotates and impedes downward flow of the developer, the developer moves upward in a central part of the developer container 51T in a horizontal section where the adjacent paddles 100 are close to each other. When the developer finishes moving upward, the developer starts moving downward according to a direction of rotation of the paddle 100 and further moves toward the outlet 50A provided in a lower portion of the developer container 51T. Thus, the developer moves in the directions shown by the arrows F and F'.

According to this exemplary embodiment, the plurality of columns of paddles 100 is provided in the horizontal section and the plurality of rows is provided along the flow-down direction of the developer. In any given row of paddles 100, the adjacent paddles 100 rotate in directions different from each other. Thus, the developer is circulated in the developer container 51T, so that the developer is dispersed and mixed with increased efficiency compared to a case in which the developer merely moves down. Accordingly, since the developer is properly dispersed, toner particles contacts a carrier with improved frequency, and scraped or slid against the carrier when passing through the mesh, serving as a gap, thereby improving a charging ability of the toner particles and preventing a decrease in density of the developer.

Figure 9A:
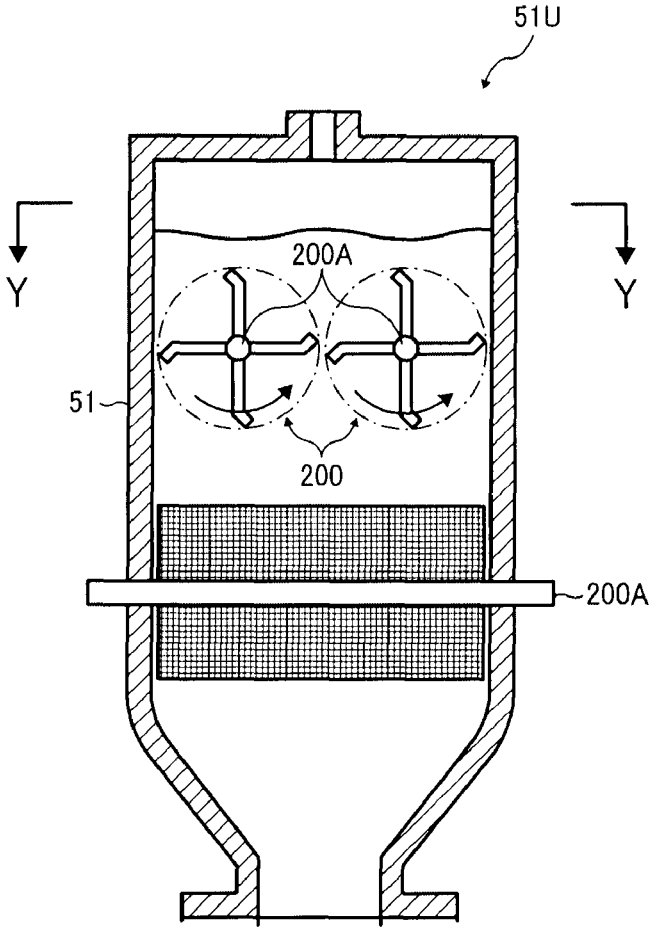
FIG. 9A is a sectional side view of a developer container according to yet another exemplary embodiment.
Figure 9B:
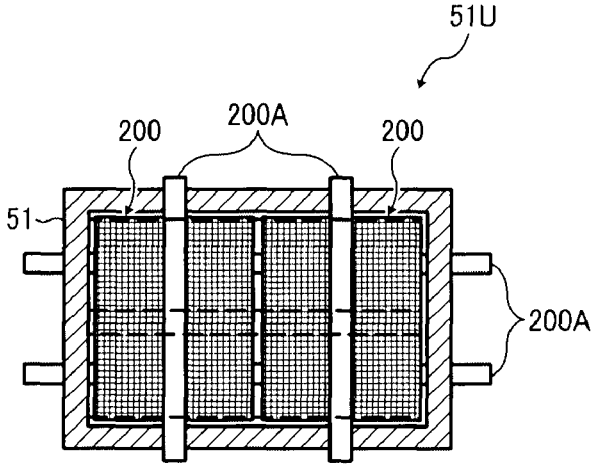
FIG. 9B is a top sectional view of the developer container shown in FIG. 9A seen in a direction Y.

As an alternative arrangement, a plurality of rotary shafts 100A in one row extending in the horizontal direction need not extend parallel to a plurality of rotary shafts 100A in another row. Referring to FIGS. 9A and 9B, a description is now given of such arrangement of rotary shafts in a developer container 51U of the development device 5Y (depicted in FIG. 2) according to yet another exemplary embodiment. FIG. 9A is a sectional view of the developer container 51U. FIG. 9B is a top sectional view thereof seen in a direction Y in FIG. 9A.

The developer container 51U includes paddles 200. The paddle 200 includes a rotary shaft 200A.

The paddle 200 serves as an agitator. The rotary shafts 200A in one row (e.g., an upper row) extend perpendicular to the rotary shafts 200A in another row (e.g., a lower row) in a horizontal section perpendicular to the flow-down direction of the developer.

Accordingly, the developer is circulated in the developer container 51U in a more complicated manner (e.g., in various directions), causing the toner particles to contact the carrier with improved frequency, thereby improving a charging ability of the developer.

Figure 10:
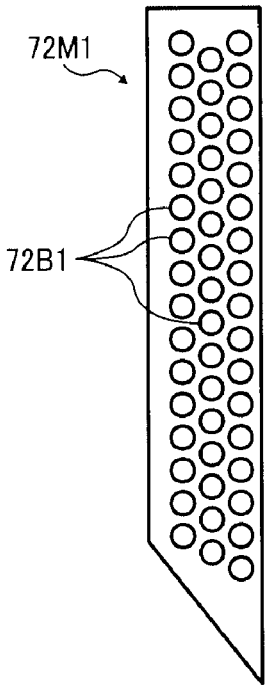
FIG. 10 is a schematic view of a modification example of a second agitator included in the developer container shown in FIG. 6.

Referring to FIGS. 10, 11, 12, and 13, a description is now given of modifications of the outer agitator 72 of the developer container 51S (depicted in FIG. 6). FIG. 10 is a schematic view of an outer agitator 72M1 as a first modification of the outer agitator 72. The outer agitator 72M1 includes holes 72B1.

Modification of a number, a size, a shape, a position, and the like, of the hole 72B1 may improve an agitation efficiency of the developer and reduce stress on the developer.

Figure 11:
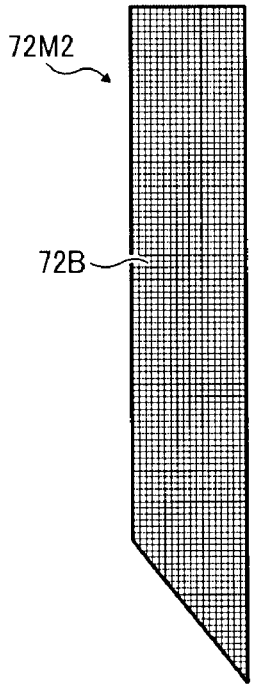
FIG. 11 is a schematic view of another modification example of a second agitator included in the developer container shown in FIG. 6.

FIG. 11 is a schematic view of an outer agitator 72M2 as a second modification of the outer agitator 72 (depicted in FIG. 6). The outer agitator 72M2 includes a mesh 72B.

The mesh 72B may have a net-like shape providing a large gap rate (e.g., a large opening area), so that toner particles and a carrier may be efficiently dispersed, thereby reducing the rotation speed of the outer agitator 72M2 and also reducing stress on the developer.

In addition, in order to increase a frequency of contact between toner particles and carrier and to improve a frictional charging ability of the toner particles, a size of a gap of the mesh 72B may be preferably large enough to allow the carrier to pass through and also large enough to allow toner particles to contact the carrier easily and smoothly. To be more specific, when the size of the gap of the mesh 72B ranges from about 0.1 mm to about 5 mm, the carrier may not clog the mesh 72B. Moreover, the mesh 72B may cope with various sizes of the carrier. For example, the carrier with an increased particle diameter may pass through the mesh 72B.

Figure 12:
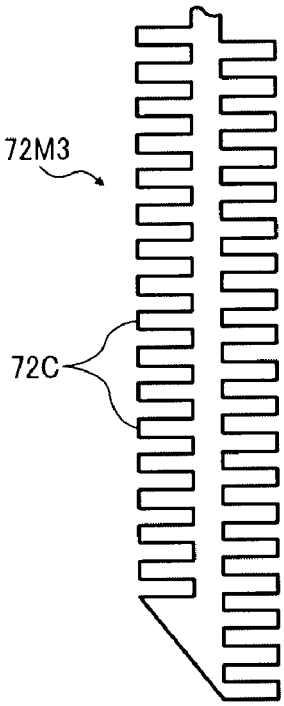
FIG. 12 is a schematic view of yet another modification example of a second agitator included in the developer container shown in FIG. 6.

FIG. 12 is a schematic view of an outer agitator 72M3 as a third modification of the outer agitator 72 (depicted in FIG. 6). The outer agitator 72M3 includes a comb 72C.

Like the above examples using the hole 72B1 (depicted in FIG. 10) and the mesh 72B (depicted in FIG. 11), the developer may pass through a space between teeth of the comb 72C, thereby improving the dispersion efficiency of the developer. The dispersion efficiency of the developer depends on a size or a length of the teeth, or a distance between the adjacent teeth. Further, the comb 72C may include a flexible material, so as to improve an efficiency of movement of the developer.

Figure 13:
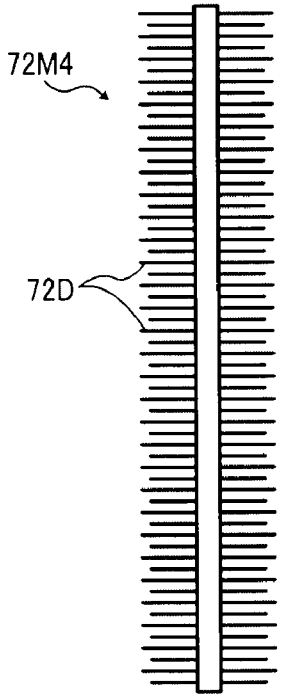
FIG. 13 is a schematic view of yet another modification example of a second agitator included in the developer container shown in FIG. 6.

FIG. 13 is a schematic view of an outer agitator 72M4 as a fourth modification of the outer agitator 72 (depicted in FIG. 6). The outer agitator 72M4 includes a brush 72D.

Like the example using the comb 72C (depicted in FIG. 12), the developer may pass through a space between bristles of the brush 72D. In addition, since the brush 72D may have a significantly larger contact area in which the brush 72D contacts the developer than the holes 72B1 (depicted in FIG. 10), the mesh 72B (depicted in FIG. 11), and the comb 72C (depicted in FIG. 12) have, the toner particles may contact the carrier with increased frequency, thereby improving an efficiency of frictional charging of the toner particles. Moreover, selection of a material of the brush 72D may improve the agitation efficiency of the developer as well as reduce the agitation stress on the developer, thereby efficiently charging the toner particles.

According to the above-described exemplary embodiments, use of the holes 72B1 (depicted in FIG. 10), the mesh 72B (depicted in FIG. 11), the comb 72C (depicted in FIG. 12), or the brush 72D (depicted in FIG. 13) may reduce contact resistance of the developer against the outer agitator 72M1 (depicted in FIG. 10), the outer agitator 72M2 (depicted in FIG. 11), the outer agitator 72M3 (depicted in FIG. 12), or the outer agitator 72M4 (depicted in FIG. 13), so as to reduce damage to the developer, thereby preventing degradation of the developer.

According to the above-described exemplary embodiments, an agitator (e.g., the outer agitator 72 depicted in FIG. 6) may include a hole (e.g., the hole 72B1 depicted in FIG. 10), a mesh (e.g., the mesh 72A depicted in FIG. 6 and the mesh 72B depicted in FIG. 11), a comb (e.g., the comb 72C depicted in FIG. 12), or a brush (e.g., the brush 72D depicted in FIG. 13). However, it may include any member having a gap. Alternatively, a material of the carrier may be used or applied to a surface of the agitator having a gap, so as to efficiently charge the toner particles due to frictional contact with the surface of the agitator.

As can be appreciated by those skilled in the art, although the present invention has been described above with reference to specific exemplary embodiments the present invention is not limited to the specific embodiments described above, and various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A development device, comprising:

a development member configured to develop an electrostatic latent image formed on a latent image carrier with a developer including toner and a carrier to make the electrostatic latent image visible;

a circulation member configured to receive the developer discharged from the development member in an outward path of the circulation member and convey the developer back to the development member in a return path of the circulation member; and a container provided between the outward path and the return path to store the developer, the container including a first agitator and a second agitator that are provided inside the container and are configured to agitate and mix the developer and fresh toner supplied to the container, the first agitator including a rotatable agitation member in which one or more holes are formed through which the developer passes and that is configured to rotate at a different speed than the second agitator around an outer circumference of the second agitator.

2. The development device according to claim 1, wherein the container has a funnel-like portion of decreasing diameter extending toward a bottom of the container and includes an inlet provided in an upper part thereof and an outlet provided in a lower part thereof, wherein the second agitator agitates the developer supplied from the inlet of the container to impede movement of the developer flowing downward in the container by gravity.

3. The development device according to claim 1, wherein the first agitator agitates the developer in a direction perpendicular to a flow-down direction of the developer.

4. The development device according to claim 1, wherein the second agitator is configured to rotate around a central part of the container, the second agitator including a screw auger having a rotary shaft extending in a vertical direction in the central part of the container, wherein the first agitator is disposed in an outer side of the screw auger of the second agitator and includes a paddle rotatable around the rotary shaft of the screw auger.

5. The development device according to claim 1, wherein the first agitator includes a rotary shaft extending in a horizontal direction perpendicular to a flow-down direction of the developer and the rotatable agitation member includes a paddle provided on the rotary shaft.

6. The development device according to claim 5, wherein the second agitator is provided under the first agitator in such a manner that a first row formed of the first agitator and a second row formed of the second agitator are provided along the flow-down direction of the developer.

7. The development device according to claim 6, wherein the rotary shaft of the first agitator extends in a first direction perpendicular to a second direction in which a rotary shaft of the second agitator extends in a horizontal direction.

8. The development device according to claim 6, wherein each of the first agitator and the second agitator includes a first paddle configured to rotate in a first direction and a second paddle configured to rotate in a second direction different from the first direction.

9. The development device according to claim 1, wherein the rotatable agitation member of the first agitator includes the one or more a holes forming a mesh in an inner part of the first agitator.

10. The development device according to claim 1, wherein the rotatable agitation member of the first agitator has a comb-like shape.

11. The development device according to claim 1, wherein the rotatable agitation member of the first agitator includes a brush.

12. The development device according to claim 1, further comprising:

a motor, the motor directly connected to the second agitator and the motor indirectly connected to the first agitator via deceleration gears.

13. The development device according to claim 1, further comprising:

a rotary feeder that includes a rotor provided with a plurality of blades extending in a radial direction and a stator covering the rotor, the rotary feeder connected to a bottom of the container.

14. The development device according to claim 1, further comprising:

an air pump connected to the circulation member to generate a driving force to return the developer to the development member via the return path of the circulation member.

15. The development device according to claim 1, wherein the first agitator includes two paddles that are positioned opposite from one another across a center of a rotary shaft of the second agitator.

16. An image forming apparatus, comprising:

a latent image carrier configured to carry an electrostatic latent image; and a development device configured to develop the electrostatic latent image carried by the latent image carrier, the development device, including:

a development member configured to develop the electrostatic latent image formed on the latent image carrier with a developer including toner and a carrier to make the electrostatic latent image visible;

a circulation member configured to receive the developer discharged from the development member in an outward path of the circulation member and convey the developer back to the development member in a return path of the circulation member; and a container provided between the outward path and the return path to store the developer, the container including a first agitator and a second agitator that are provided inside the container and are configured to agitate and mix the developer and fresh toner supplied to the container, the first agitator including a rotatable agitation member in which one or more holes are formed through which the developer passes and that is configured to rotate at a different speed than the second agitator around an outer circumference of the second agitator.

* * * * *